US006447308B1

(12) United States Patent
McCarthy et al.

(10) Patent No.: US 6,447,308 B1
(45) Date of Patent: Sep. 10, 2002

(54) METHOD AND DEVICE FOR INCREASING ELASTOMERIC INTERCONNECTION ROBUSTNESS

(75) Inventors: Matthew McCarthy, Taunton; Everett Simons, Mansfield, both of MA (US)

(73) Assignee: Paricon Technologies Corporation, Fall River, MA (US)

( * ) Notice: Subject to any disclaimer, the term of this patent is extended or adjusted under 35 U.S.C. 154(b) by 0 days.

(21) Appl. No.: 09/999,599

(22) Filed: Oct. 31, 2001

Related U.S. Application Data

(60) Provisional application No. 60/244,549, filed on Oct. 31, 2000.

(51) Int. Cl.[7] ..... H01R 4/58
(52) U.S. Cl. ..... 439/91; 439/591
(58) Field of Search ..... 439/91, 66, 86, 439/55, 586, 591, 71, 74, 908; 174/254, 262; 361/785, 705, 764

(56) References Cited

U.S. PATENT DOCUMENTS 4,820,376 A * 4/1989 Lambert et al. ..... 156/643
5,618,189 A * 4/1997 Jin et al. ..... 439/91
5,810,607 A * 9/1998 Shih et al. ..... 439/66
5,991,165 A * 11/1999 Jones, Jr. et al. ..... 361/816
6,052,286 A * 4/2000 Worthen et al. ..... 361/756
6,081,429 A * 6/2000 Barrett ..... 361/767
6,168,442 B1 * 1/2001 Naoi ..... 439/91
6,270,363 B1 * 8/2001 Brofman et al. ..... 439/91
6,332,786 B1 * 12/2001 Suga et al. ..... 439/91

* cited by examiner

*Primary Examiner*—P. Austin Bradley
*Assistant Examiner*—Ross Gushi
(74) *Attorney, Agent, or Firm*—Mirick, O'Connell, DeMallie & Lougee, LLP

(57) ABSTRACT

An elastomeric device for interconnecting two or more electrical components. The device includes an elastomeric matrix having one or more outer surfaces, one or more electrically conductive pathways through the matrix, and a frame for stretching the elastomer perpendicular to the electrical pathways.

14 Claims, 5 Drawing Sheets

METHOD AND DEVICE FOR INCREASING ELASTOMERIC INTERCONNECTION ROBUSTNESS

This application claims the benefit of provisional application 60/244,549 filed on Oct. 31, 2000.

FIELD OF THE INVENTION

This invention relates to improved conductive elastomer interconnection devices, and methods for making them.

BACKGROUND OF THE INVENTION

As electronic systems get smaller, faster and lower cost, the classic methods of separable interconnection need to be replaced with new technologies. One such technology is based on anisotropic conducting polymer materials. Anisotropic Conducting Elastomers (ACE) are elastomers which conduct in one direction but are insulators in the other direction. One such example is ECPI-(Elastomeric Conducting Polymer Interconnect) a material developed by Lucent Technologies-Bell Laboratories. This material is formed by magnetically aligning fine magnetic particles in sheets of uncured silicone such that the particles form arrays of electrically isolated columns. These columns are frozen in place as the silicone cures. When a layer of ECPI is compressed between two electrical conductors, the particles in the compressed column come into contact with each other and the conductors, forming an electrically conductive path. Conductivity of the column remains over a compression range, which is a function of the material design. This range, often referred to as the material's "dynamic range", provides compensation for the lack of coplanarity of the conductors. This is often referred to as "coplanarity compensation".

As devices using ECPI warm up, the polymer thermally expands more than the metal particles forming the electrically conductive columns. Initially, the polymer expands into the interstitial spaces between the pads on the device(s), and into the topological voids created by the ECPI's own surface texture. As the temperature of the polymer rises, so does the amount of thermal expansion. If the expansion fills the topological voids and the temperature continues to rise, additional thermal expansion reduces the mechanical loading force on the (relatively rigid) conductive columns. If the polymer gets too hot and thus expands too much, the reduction in force on the particles in the conductive columns (which are initially compressed along the direction of the electrical paths) may cause the resistance to increase beyond acceptable limits.

In a typical application of ECPI, the interconnect formed using the ECPI replaces the soldered interconnect to allow a separable interconnection. Separable interconnection is generally required for testing the device, conditioning the device (burn-in) and for final application in the OEM product. One such example is in a Land Grid Array (LGA) where an array of pads on a device needs to be connected to a matching array on a board. A second example is when a Ball Grid Array (BGA), consisting of a device with an array of solder balls, is to be separably connected to a matching array on the board. In both of these examples, a layer of ECPI material placed between the device and the board can, when properly used, provide a reliable connection.

Moreover, the behavior of the elastomeric material is critical to the success of the interconnect's performance. Typical highly filled elastomeric materials exhibit poor elastic properties, and when formed into discrete button-like contacts, tend to move like putty, taking a severe set. These materials exhibit little residual spring force. These factors impact on the reliability of the contact, and virtually preclude multiple device insertions with different devices. Because these highly filled materials have poor elastic properties, an external spring member is required to create a contact force. However, the elastomeric button flows continuously under the force. The conventional solution is to limit the flow with a stop. The net effect is a very low contact force. In addition, elastomers in sheet form can have excellent elastic properties, but tend to behave like incompressible fluids. This behavior demands that the connector system design using sheet elastomers provide for a place for the material to move.

SUMMARY OF THE INVENTION

The device and methods of the invention provide a unique improvement to anisotropic conductive elastomers, and more specifically to ECPIs, which enhances performance and reliability, and broadens the range of applications.

It is therefore a primary object of this invention to provide a device for anisotropically or isotropically interconnecting two or more components, which enhances the quality and reliability of the interconnection.

It is a further object of this invention to provide a device for interconnecting two or more components, which is capable of accommodating repeated thermal excursions when in use.

It is a further object of this invention to provide a device for interconnecting two or more components using a compressive load, which reduces the distortion of electrical pathways during the assembly process by pre-expanding the interconnect medium in the plane that it would have been partially extruded into by the application of the compressive load.

It is a further object of this invention to provide a device for interconnecting two or more components, which resists the distortion from thermal or mechanical changes perpendicular to electrically conductive pathways within an anisotropically conductive medium, by constraining the perimeter of the anisotropically conductive medium.

It is a further object of this invention to provide, in a device for interconnecting two or more components, mechanical features to align the components.

It is a further object of this invention to provide a device for interconnecting two or more components, which is capable of repeated use for testing, conditioning and final application of the components.

It is a further object of this invention to provide a device for interconnecting two or more components, which provides flow space into which the elastomer materials in the device may flow under compression.

To increase the maximum reliable operating temperature of the ECPI, the material is stretched in a direction perpendicular to the conductive paths, which for a sheet form is along the plane of the sheet. The tension causes the elastomer within the matrix to contract vertically. The ratio of vertical contraction to horizontal pulling, in the absence of any conductive paths, is called the Poisson's ratio of the material. However, the ECPI sheet contains vertical columns of conductive particles, which are much stiffer (and stronger) than the elastomer. The ECPI sheet thus vertically contracts more in the areas between the columns than at the columns. This contraction between the columns greatly increases the volume of topological voids at the surface of the ECPI, thus increasing the maximum temperature at which the ECPI can reliably operate.

An added advantage of stretching the ECPI and securing it to a frame prior to its being compressed between devices is the reduction in lateral distortion during the assembly process. With typical systems, as the ECPI sheet is compressed, it is slightly extruded laterally, causing the columns towards the perimeter to bow. Since the top and bottom of the ECPI sheet are constrained by friction, the middle of the sheet moves laterally more than the surfaces, causing initially vertical columns to bow. If the lateral motion of the ECPI is constrained during the assembly process, this bowing is prevented.

The stretched ECPI of the invention also reduces the standard deviation of measured resistances, compared to typical results with otherwise identical configurations.

A preferred embodiment of the elastomeric device of the invention for electrically interconnecting two or more components, comprises: an elastomeric matrix having one or more outer surfaces; one or more electrically conductive pathways through the matrix; and a frame that holds the elastomeric matrix stretched along its plane (i.e., perpendicular to the electrically conductive pathways).

The pathways may initially be isotropic or anisotropic. In the latter instance, the pathways preferably comprise between about 2 to 25% magnetic particles by volume of the elastomeric matrix. A plurality of the magnetic particles are preferably aligned to form one or more arrays of electrically isolated conductive columns having at least one end. The elastomeric matrix is stretched in such a manner that the elastomeric material within the matrix contracts along the axis parallel to the conductive columns, thereby creating void space into which the elastomeric material may expand when heated.

The outer surfaces of the matrix typically comprise a first surface adapted to face one of the components and a second surface adapted to face a second of the components, wherein one or more of the pathways extends from at least proximate the first surface to at least proximate the second surface, and wherein one or more of the pads are located on the first and second surfaces.

The device of the invention may further comprise one or more support films. At least one of the support films is preferably a carrier sheet. At least one of the support films is preferably removable. One or more of the components may comprise registration holes. At least one of the films may comprise one or more registration holes in the film which correspond to the registration holes of the component, and through which one or more precision registration pins may be passed. In instances wherein one or more of the components comprises registration holes, one or more of the films may comprise one or more precision pins, which correspond to one or more of the registration holes of the components. At least one of the films may comprise one or more mounting holes in the film which are at least partially filled with the elastomeric matrix; and/or at least one of the films comprises one or more contact holes that may be adapted to receive therein at least one or more of the pads, wherein at least one or more of the pads may have an outer surface which protrudes from the contact holes. In instances wherein at least one of the films is removable, the removable film, if removed, will preferably leave behind spaces between two or more of the pads into which at least a portion of the matrix may flow when compressed.

The preferred method of the invention, for making an elastomeric device for electrically interconnecting two or more components, comprises the steps of: embedding a plurality of conductive, magnetic particles in an elastomer which retains most of its modulus of compression over a temperature range of between about 20° C. to 70° C. by mixing the particles in the elastomer before the elastomer sets, and applying a magnetic force to the particles so that the particles align themselves in electrically isolated columns as the elastomer sets, to form an elastomeric matrix having one or more outer surfaces and comprising one or more electrically conductive pathways through the matrix. One or more electrically conductive contact pads are provided. The matrix is then stretched perpendicular to the electrically conductive pathways.

The pathways used in the method of the invention may be anisotropic and may comprise between about 2 to 25% magnetic particles by volume of the elastomeric matrix. A plurality of the columns of magnetic particles may have at least one end particle proximate to one or more of the outer surface of the matrix, and one or more of the pads is in intimate contact with an end particle of one or more of the columns of particles.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The elastomeric device of the invention, for electrically interconnecting two or more components, generally includes the following basic elements: an elastomeric matrix having one or more outer surfaces; one or more electrically conductive pathways through the matrix; and a frame that holds the matrix in tension (stretched) perpendicular to the electrically conductive pathways.

Bulk Properties of Elastomer

Magnetically aligned systems, such as ECPI, use less metal than elastomer (by volume), and the material's in-plane properties tend to take on the elastic behavior of the base elastomer. However, as noted above, the behavior of the elastomeric material is critical to the success of the device's performance. Previously used materials, such as highly filled materials, typically exhibit little residual spring force, which reduces the reliability of the contact and virtually precludes multiple device insertions with different devices. In the present invention, these drawbacks are overcome by using a matrix comprised of elastomers which exhibit nearly perfect elasticity over abroad temperature range. Specifically, a 1:1 mixture of GE-615 and GE-630 silicone Electric Corp.) has been identified as having close to ideal behavior. In a preferred embodiment, the matrix is formed from a blend of from 2% to 25% by volume of magnetically aligned particles in a base of GE-615 plus GE-630 or equivalent (by equivalent is meant an elastomeric material that retains most of its modulus of compression over a temperature range of 20° C. to 70° C.) This combination will not take a set over a wide temperature range.

Figure 1:
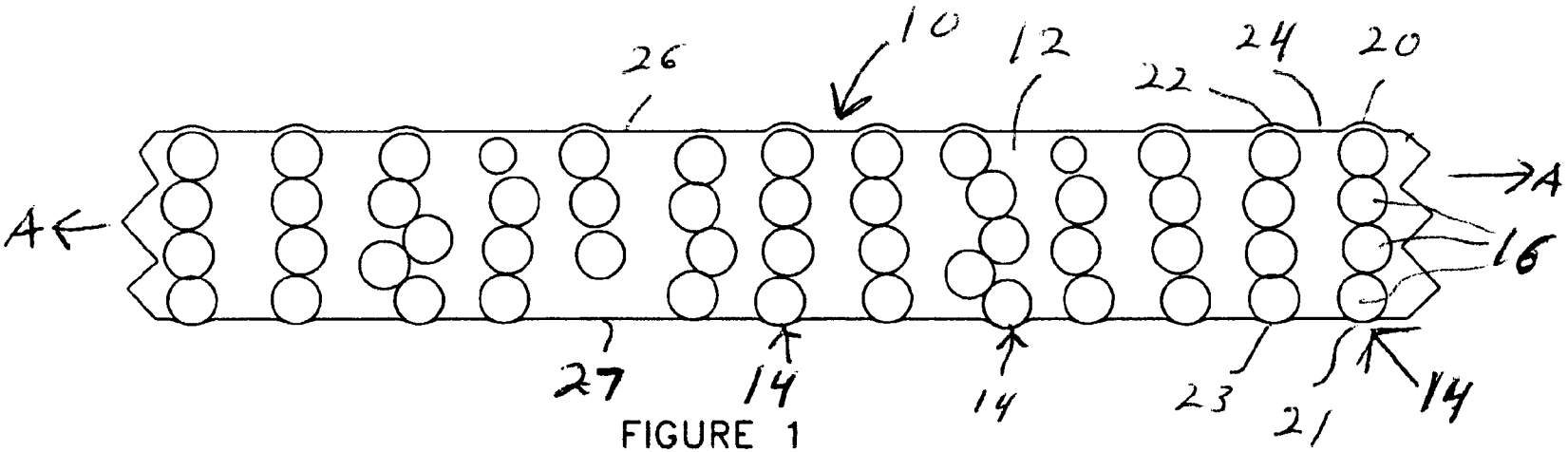
FIG. 1 is a partial cross-sectional view of an elastomeric conductor using magnetically aligned particles of this invention after laterally stretching the elastomeric conductor, thus causing a vertical contraction of the elastomeric matrix relative to the heights of the electrically conductive columns.

Generally, to carry out the method of the invention, for making an elastomeric device for electrically interconnecting two or more components, a plurality of conductive, magnetic particles 16, FIG. 1, are embedded in an elastomer 12 which preferably retains most of its modulus of compression over a temperature range of between about 20° C. to 70° C., by mixing the particles in the elastomer before the elastomer sets and applying a magnetic force to the particles so that the particles align themselves in electrically isolated columns 14 as the elastomer sets to form an elastomeric matrix having one or more outer surfaces 26, 27 and comprising one or more electrically conductive pathways 14 through the matrix. After the particles are embedded, the matrix is stretched in the direction perpendicular to the electrically conductive pathways (in the direction of arrows A). The matrix can be stretched mechanically, or thermally expanded. The stretching causes the ends of columns 14 to bulge out of the surface, as shown schematically at areas 20–23. The areas 24 between the column ends are located below the column ends, creating voids into which the elastomer can expand as it is heated. It is then bonded to a frame. Alternatively, the matrix may be held in tension until it is assembled; the assembly in this case maintains the matrix in tension. The matrix is then compressed between the components to be electrically interconnected.

Figure 2A:
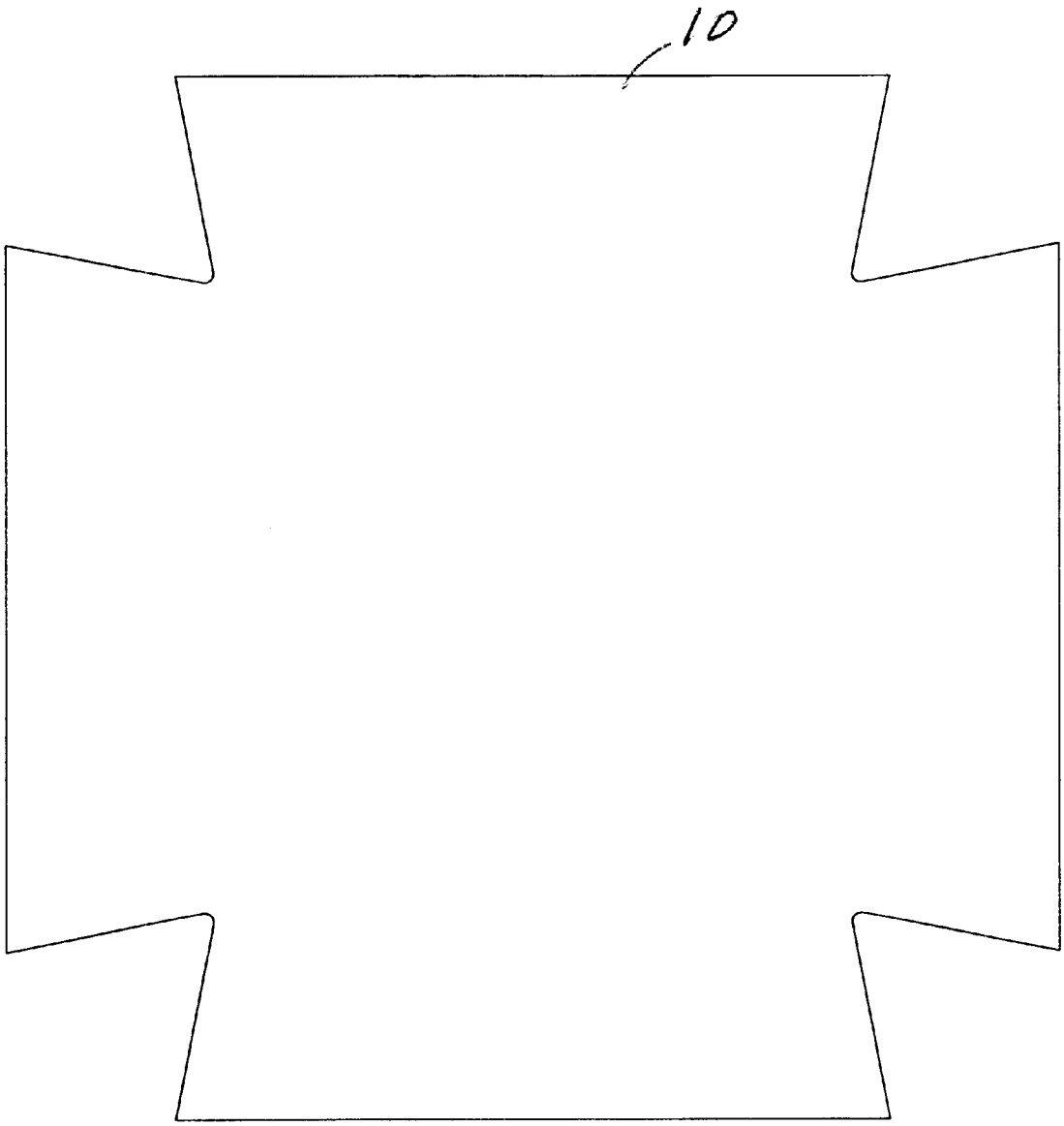
FIG. 2A is a top view of an elastomeric sheet for this invention that is to be stretched on a frame.
Figure 2B:
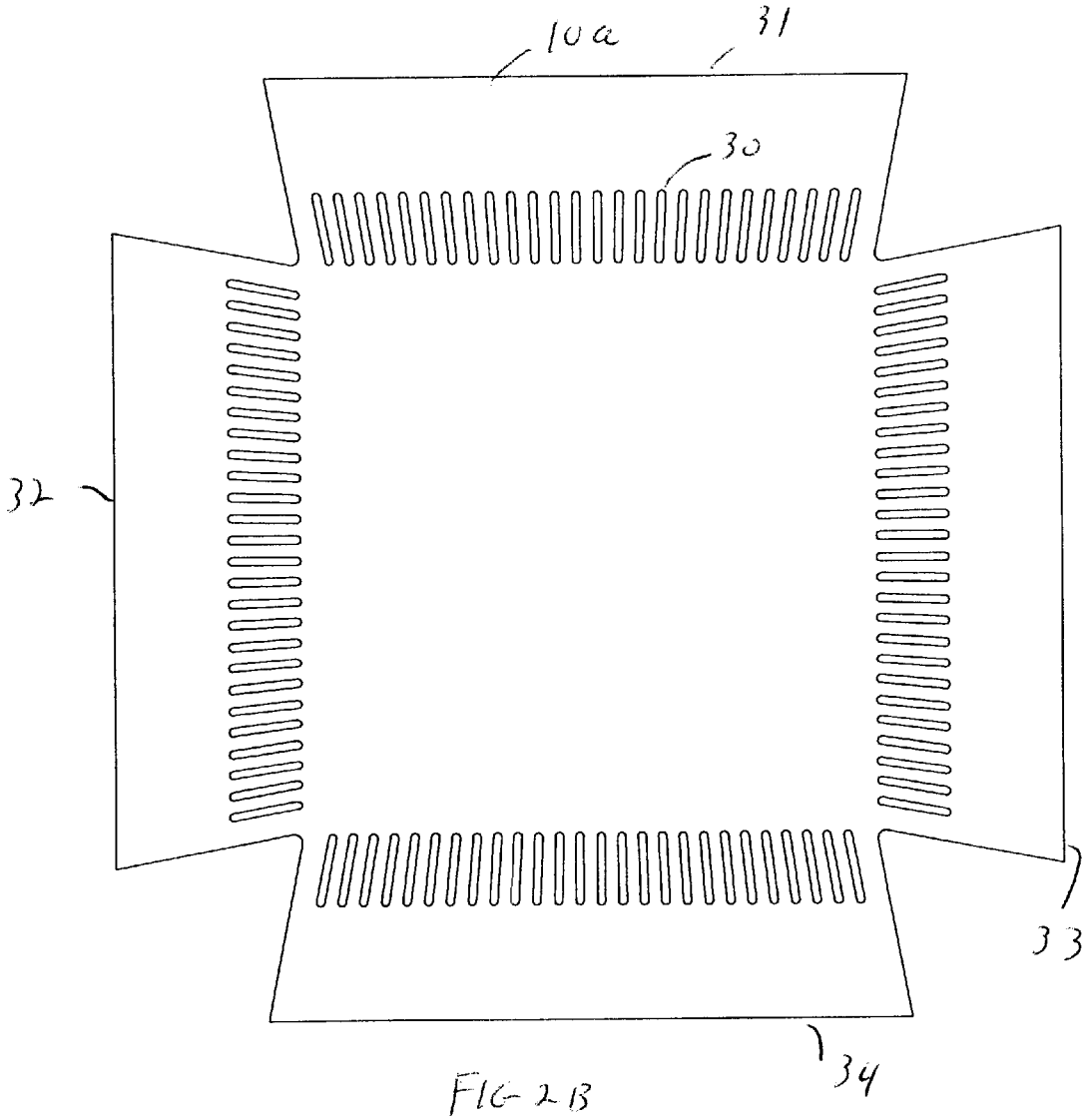
FIG. 2B shows the same sheet with stress relief slots.
Figure 3:
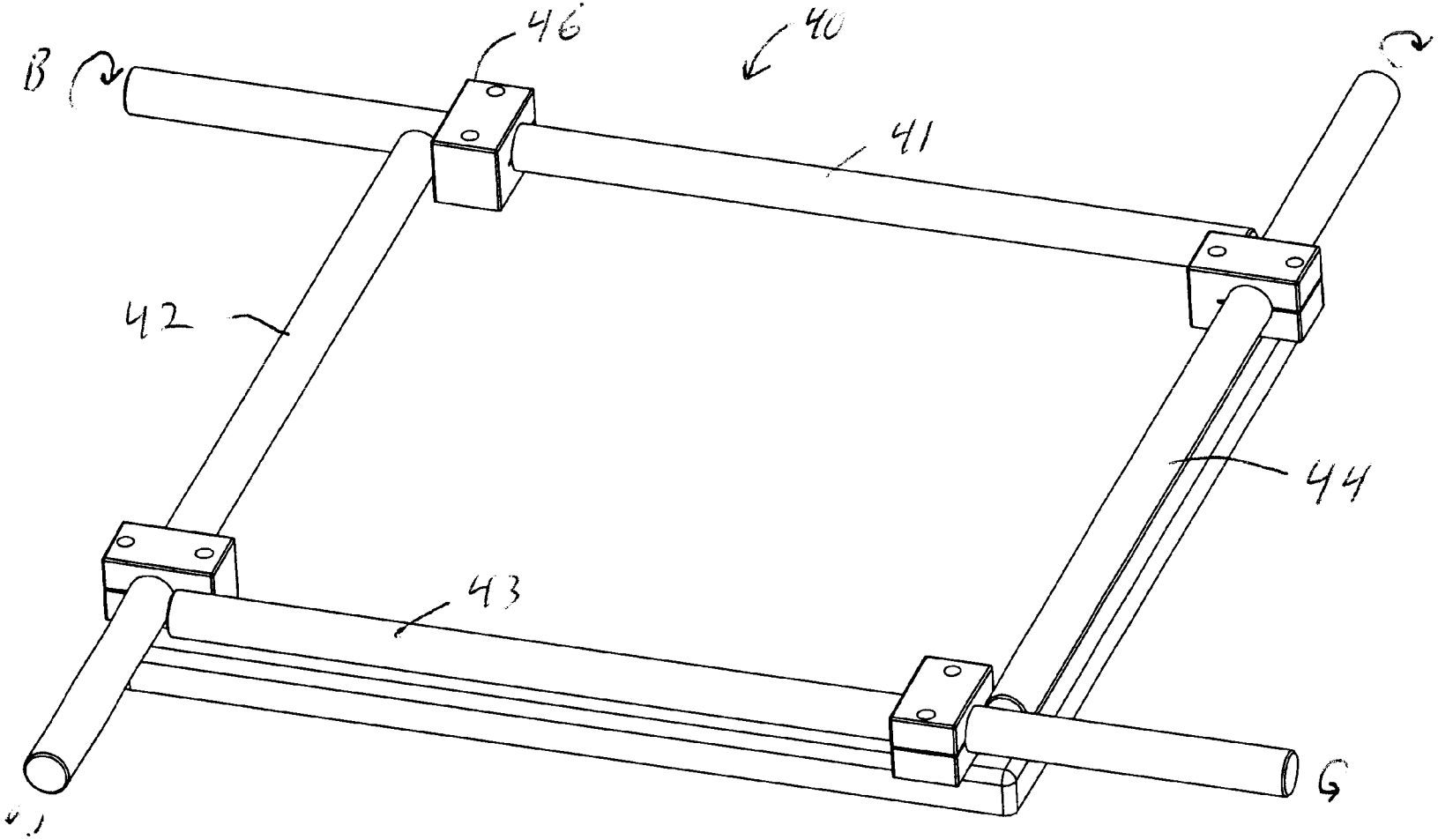
FIG. 3 shows a device used to stretch the elastomeric sheet.
Figure 4:
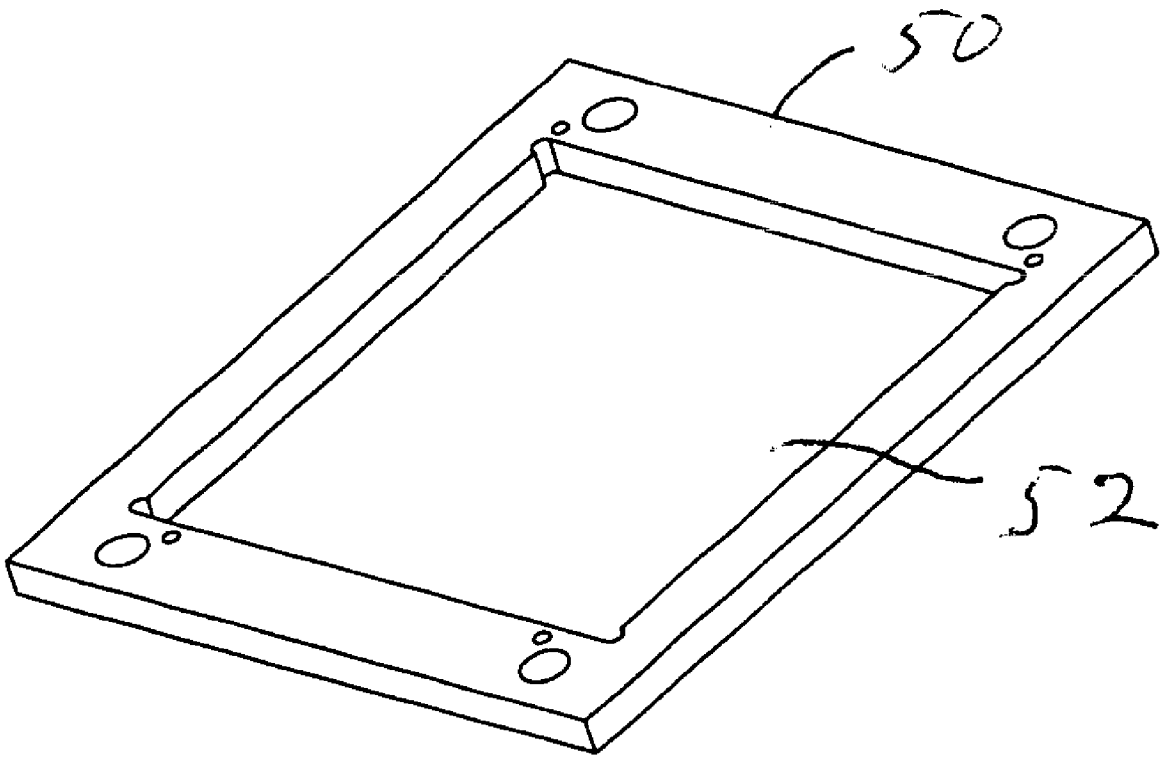
FIG. 4 shows a frame used to hold the stretched ECPI sheet and align the device to the substrate below.

In one example of the invention, a sheet 10 of the elastomeric matrix material was punched or cut to a generally "+" shape as shown in FIG. 2A. The stress release slots 30 shown in FIG. 2B allow the square central section to expand isotropically, even though the ends of the cut sheet's four arms will be constrained and thus only able to expand uniaxially. The ends of the cut sheet's four arms 31–34 were then attached by tape to the stretching mechanism 40 shown in FIG. 3. The mechanism has opposed, relatively movable portions. The four rods 41–44 of the stretching mechanism were then rotated such that they stretched the cut sheet of elastomeric material by about 5%, in the direction indicated by arrow B. Locking mechanisms 46 hold the rods in place to maintain the ECPI sheet in tension. The effect of the stretching is visibly obvious: the previously flat glossy bottom surface becomes visibly rough, with a matte appearance. With the material in the stretched state, a fiberglass frame 50, shown in FIG. 4, was then glued to the material using Loctite's Permatix Blue RTV Silicone Gasket Maker, Part No. 6B. After a one-day cure, the excess material outside the frame was cut away, leaving the frame and ECPI bonded together with the ECPI in tension. Measuring the amount of stretch (i.e., the area of the sheet) and the thickness of the sheet before and after stretching showed an apparent 6–7% increase in volume of the sheet. Since the actual volume could not change significantly, this apparent change comes from the topology (increased roughness) created when the elastomer pulls inwards from the surfaces, but the height of the conductive columns remains essentially unchanged. This creates the interstitial volume that is the desired end result of the invention.

Although specific features of the invention are shown in some drawings and not others, this is for convenience only as some feature may be combined with any or all of the other features in accordance with the invention. Other embodiments will occur to those skilled in the art and are within the following claims.

What is claimed is:

1. A device for electrically interconnecting two or more components, comprising, an elastomeric matrix having one or more outer surfaces, and one or more electrically conductive pathways through the matrix; and a mechanical device holding the matrix under tension, with the matrix stretched substantially perpendicular to the electrical pathways.

2. The device of claim 1, wherein the mechanical device comprises a frame defining an open portion, wherein the matrix spans the open portion.

3. A method of interconnecting two or more components, comprising, providing an elastomeric matrix having one or more outer surfaces and comprising one or more electrically conductive pathways through the matrix;

mechanically stretching the elastomeric matrix substantially perpendicular to the electrical pathways; and compressing the stretched elastomeric matrix between the two or more components to be interconnected.

4. The method of claim 3, wherein the elastomeric matrix is stretched uniformly.

5. The method of claim 4, wherein the stretching is in orthogonal directions.

6. The method of claim 3, wherein the elastomeric matrix is stretched by pulling it at one or more locations along its edge.

7. The method of claim 6, wherein a device with opposed relatively movable portions is used to stretch the elastomeric matrix.

8. The method of claim 7, wherein the elastomeric matrix is attached to the device with opposed, relatively movable portions at least two spaced locations around the periphery of the elastomeric matrix.

9. The method of claim 8, wherein the elastomeric matrix has a generally "+" shape defining two sets of opposed ends, and each of the ends is attached to an opposed movable portion of the device.

10. The method of claim 9, wherein the elastomeric matrix is stretched by relative movement of the opposed movable portions of the device.

11. The method of claim 3, further comprising providing a frame device defining an open portion, and attaching the stretched elastomeric matrix to the frame, spanning the open portion.

12. The method of claim 11, wherein the elastomeric matrix is attached to the frame by bonding.

13. The method of claim 12, wherein the bonding is accomplished with an adhesive substance.

14. A method of interconnecting two or more components, comprising, providing an elastomeric matrix having one or more outer surfaces and comprising one or more electrically conductive pathways through the matrix;

expanding the elastomeric matrix at least in the plane substantially perpendicular to the electrical pathways; and compressing the expanded elastomeric matrix between the two or more components to be interconnected.

* * * * *